US005551368A

United States Patent [19]

Vire

[11] Patent Number: 5,551,368

[45] Date of Patent: Sep. 3, 1996

[54] CONTAINER FOR LAUNCHING A LIGHTWEIGHT TORPEDO FROM A SURFACE CRAFT

[75] Inventor: René Vire, Hyeres, France

[73] Assignee: L'Etat Francais, represente par le Delegue Ministeriel pour l'Armement, Paris, France

[21] Appl. No.: 371,746

[22] Filed: Jan. 12, 1995

[51] Int. Cl.[6] ..... B63B 1/00

[52] U.S. Cl. ..... 114/238; 89/1.81

[58] Field of Search ..... 114/316, 318, 114/238, 239, 20.1, 21.1, 21.2; 89/1.806, 1.807, 1.809–1.814

[56] References Cited

U.S. PATENT DOCUMENTS

| | | | |
|---|---|---|---|
| 3,106,905 | 10/1963 | Gondek | 114/238 |
| 3,158,124 | 11/1964 | Chevillon | 114/238 |
| 3,578,783 | 5/1971 | Loustalet | 185/37 |
| 3,724,322 | 4/1973 | Reed | 89/1.811 |
| 3,780,617 | 12/1973 | Tabarie et al. | 89/1.811 |
| 4,047,464 | 9/1977 | Fredriksson et al. | 89/1.811 |
| 4,047,467 | 9/1977 | Lundin | 89/41 H |
| 4,079,687 | 3/1978 | Mentcher | 114/20.1 |
| 4,091,710 | 5/1978 | Liena et al. | 89/1.814 |

FOREIGN PATENT DOCUMENTS

| | | | |
|---|---|---|---|
| 1590790 | 5/1970 | France . | |
| 2301802 | 9/1976 | France . | |
| 0066734 | 12/1982 | Germany | 114/238 |

*Primary Examiner*—Edwin L. Swinehart
*Attorney, Agent, or Firm*—Oliff & Berridge

[57] ABSTRACT

A container is intended for containing a lightweight torpedo type weapon to be launched from a surface craft. The weapon includes activation structure for the batteries supplying energy to the weapon, an extraction device of the activation safety device when the weapon is launched, and a remote control connection to supply the programming of the weapon commands before it is launched. These three features are interdependent with the container, which is brought to the launching position with the weapon held in a storage position. The activation of the activation structure for the batteries and extraction device of the activation safety device, as well as the disconnection of the remote control connection, take place automatically when the weapon is launched.

17 Claims, 2 Drawing Sheets

CONTAINER FOR LAUNCHING A LIGHTWEIGHT TORPEDO FROM A SURFACE CRAFT

BACKGROUND OF THE INVENTION

The present invention relates to the launching of lightweight torpedo type weapons from a surface craft and, in particular, a container intended to store the weapon to be launched until the time of launching.

The light torpedo type weapons are generally launched from surface crafts by means of horizontal launching tubes or catapults. These launching means are arranged on the ship deck where they are usually grouped by two or three. Consequently, they are subject to direct exposure to sea elements and bad weather, as well as the risks of shell fragments during naval action; and moreover they need to be heat insulated to ensure the protection of the weapon components.

The lightweight torpedoes are stored in containers. When the weapon is launched it has to be taken out of the container, prepared to be launched, and the launching means must be installed. Unfortunately, during all this handling the weapon is not protected and even becomes brittle causing concerns for the safety of the ship.

At last, the launching is carried out by using bottles of compressed air. To launch by means of tubes, the bottles of compressed air are placed in the breech door. The sudden opening of a valve produces a high pressure at the rear part of the weapon. The weapon is then propelled towards the front part of the tube and ejected outside the ship. To launch by means of a catapult, the bottles of compressed air supply the energy to a thrustor which propels the weapon to eject it from the ship.

The lightweight torpedo type weapon comprises batteries used to supply the propulsion means. The batteries are ignited by the admission of water when the weapon takes off. Usually, a safety device isolates the load activation case and is then removed when the weapon takes off. Moreover, the torpedo comprises a remote control connected to the driving computer for the missile programming, which has to be removed as nearly as possible to the moment of launching.

Therefore, these various devices and safety means must be installed when positioning the torpedo on its launching bench with all the disadvantages inherent to their handling.

Due to the deficiencies of the prior art systems, the principal object of the invention relates to the supply of a container for a lightweight torpedo type weapon reducing handling to a minimum.

Another object of the invention is to supply a container of the type mentioned above intended to be brought on the launching bench, maintain the weapon in a storage position.

Still another object of the invention is to supply a container of the previous type comprising the safety devices required to launch the weapon, thus avoiding any weapon handling at the moment of the launching.

SUMMARY OF THE INVENTION

Therefore, the object of the invention is to provide a container intended for containing a lightweight torpedo type weapon to be launched from a surface craft. The weapon comprises a means for ignition of the batteries supplying energy for its propulsion, a means for extraction of the safety activation when launching, and a remote control connection to supply the programming of the weapon controls from a driving computer.

These various means are interdependent with the container which is brought onto the launching bench, the weapon being held in the container in storage position. The activation of the means for battery ignition and safety extraction means as well as the disconnection of the remote control connection take place automatically when the weapon is separated from its container.

DESCRIPTION OF THE PREFERRED EMBODIMENT

As previously mentioned, the object of the invention is to avoid handling the torpedo when it is installed on its firing position. The container, according to the invention, makes it possible to achieve this goal as it is moved along with the torpedo it contains, onto the launching bench.

Figure 1:
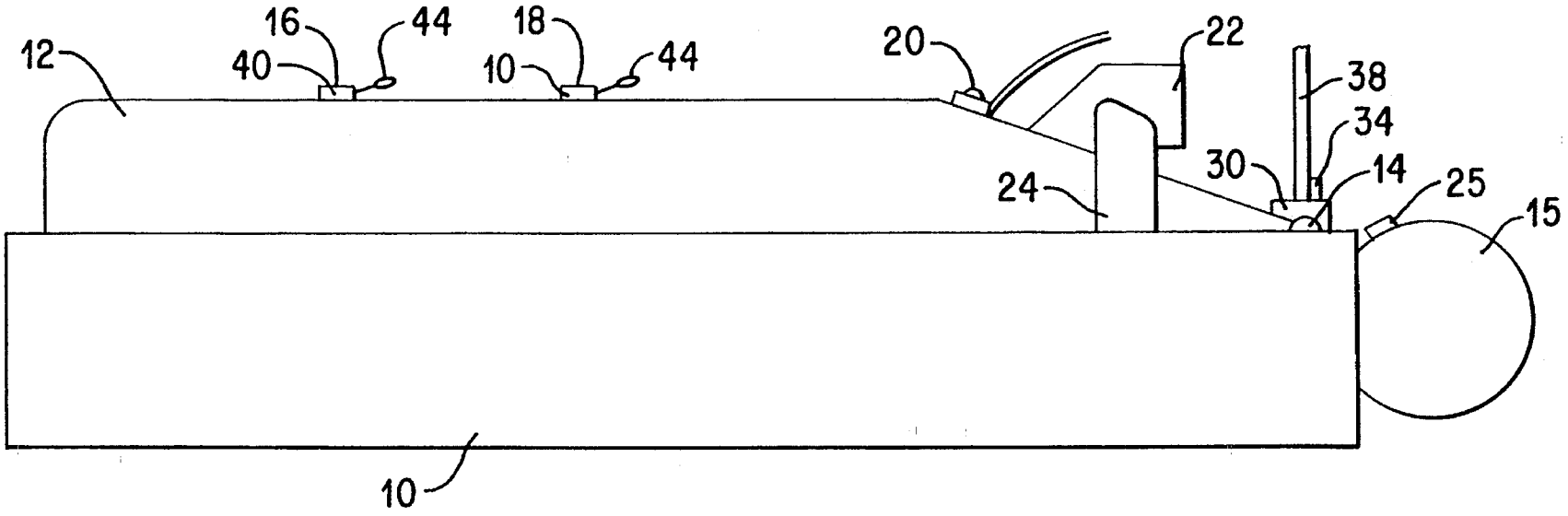
FIG. 1 is a simplified representation of the container and torpedo it contains, where the water admission pin, the activation case pin and the remote control connection appear.

Container 10, preferably cylindrical, has been shown in FIG. 1 without its upper part so that the contained torpedo 12 is visible. Torpedo 12 is immobilized in the container by means of slides (not shown) for the transverse immobilization, and by a terminal sphere 14 for the longitudinal immobilization, the explanation of which will be given hereafter.

From front to rear the torpedo comprises, a) a safety device 16 which isolates the activation case of the load and which will be removed when launching the torpedo. This safety device is also maintained by a pin. Such a safety device could be made up of a removable capsule, but the device according to the present invention can also be used to remove this capsule with the same efficiency.

b) a means for admission of water intended for igniting the battery which will deliver the energy required for the propulsion of the weapon. This means for admission of water 18 is closed by a piece held by a pin that comes out when launching.

c) a remote control connection 20 intended for the torpedo programming and the removal of which must be delayed as long as possible when launching.

d) Fin 22 and propulsion means 24 of the torpedo, and e) sphere 14 for the longitudinal immobilization.

Until the torpedo is launched, it is kept in its container by 4 slides, with spaces between to allow for the passage of the torpedo ailerons.

The standard slides are thus used to store the torpedo in its container and also to cause the torpedo to slide forward and to guide it when it is launched. Moreover, the upper slide allows for the passage of the water admission of pin 18, safety pin of activation case 16, and remote control connection 20.

Once the container has been positioned and fixed on its launching bench, the front and rear closures are taken out. Then, a launching module or expelling device is fixed on the rear part of the container. The launching module comprises a compressed air chamber 15 and a launching valve.

Figure 2:
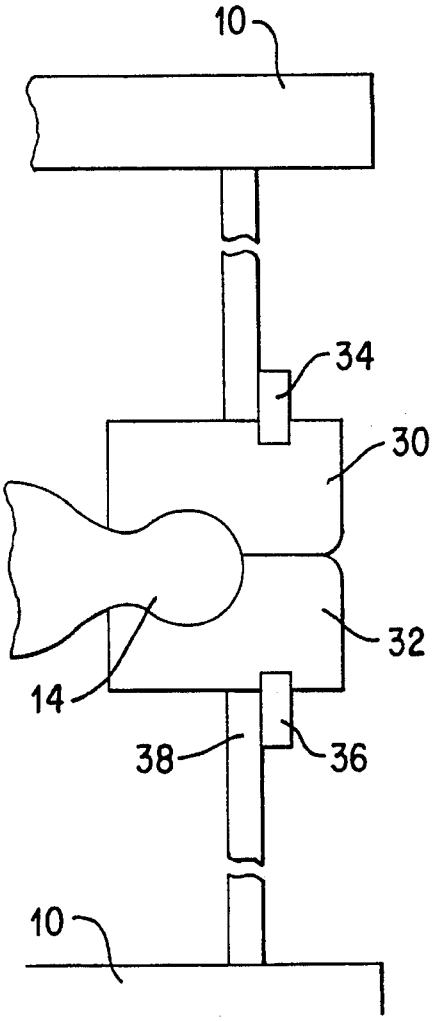
FIG. 2 is a cutaway drawing of the longitudinal immobilizing device of the torpedo, showing the final sphere held by clamps.

The torpedo is immobilized longitudinally by its terminal sphere 14 held by the device shown in FIG. 2. The two clamps 30 and 32 of this device hold in place and immobilize the torpedo at sphere 14 by means of immobilizing locks 34 and 36 of the clamps fixed to rear supporting plate 38.

At the moment selected for the launching, the valve is opened by means of explosive bolts. The sudden opening releases the compressed air at the same time as it pushes the two immobilizing locks 34 and 36 of the clamps, thus allowing clamps 30 and 32 to open and thereby to release sphere 14.

Due to the force exercised by the compressed gas, the torpedo is pushed forward and acquires a speed allowing it to enter the water according to the correct angle.

As it will be seen, when the torpedo starts moving forward, the pin closing the water admission, the activation case safety pin and the remote control connection are released.

Figure 3:
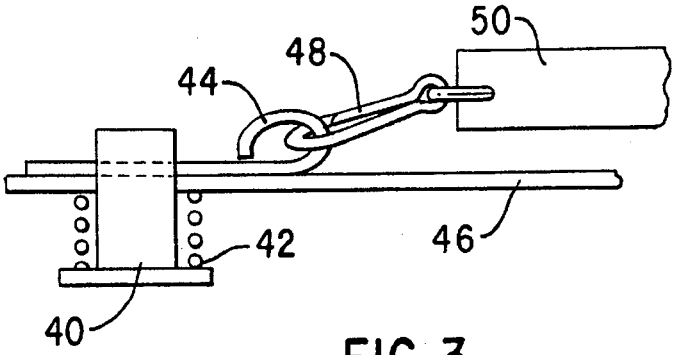
FIG. 3 is a simplified representation of the pin used for the admission of water or the safety of the torpedo activation case.

According to FIG. 3, the device for water admission for the battery ignition usually comprises a water admission lever 40 which tends to be removed in the provided chamber by means of spring 42.

But, in fact, the lever is held in place, therefore preventing any water admission, by pin 44 (pin-shaped) going through lever 40 in a housing located above the wall 46 of the torpedo. Ring pin 44 is located in a trigger snap 48 interdependent with to a leaf spring 50. Leaf spring 50 is rigidly fixed to the wall of the upper slide so that, in the steady position represented in FIG. 3, the spring is under tension.

When the torpedo starts moving forward, i.e. towards the left of FIG. 3, pin 44 held by trigger snap 48 is drawn out of its housing in lever 40. At this moment, spring 42 projects lever 40 inside the provided chamber, and the water admission is released thus allowing the batteries to be ignited when the torpedo enters sea water. At the moment the pin is drawn out from its housing, leaf spring 50 retracts laterally carrying the pin into a provided housing to of the slide, so that the pin is not located on the trajectory of the torpedo fin.

The safety device intended for isolating the activation case (16 in FIG. 1) until the torpedo is launched, is built in a way similar to that of the battery ignition. Therefore, the drawing out and removal of the activation case pin, which take place at the same time as the drawing out and removing of the pin of the battery ignition device, will not be described again.

Figure 4A:
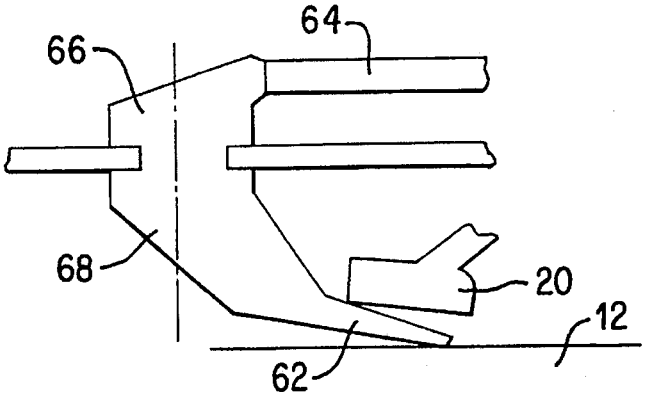
FIGS. 4*a* and 4*b* represent the device allowing the remote control connection to be pulled out when launching the torpedo.
Figure 4B:
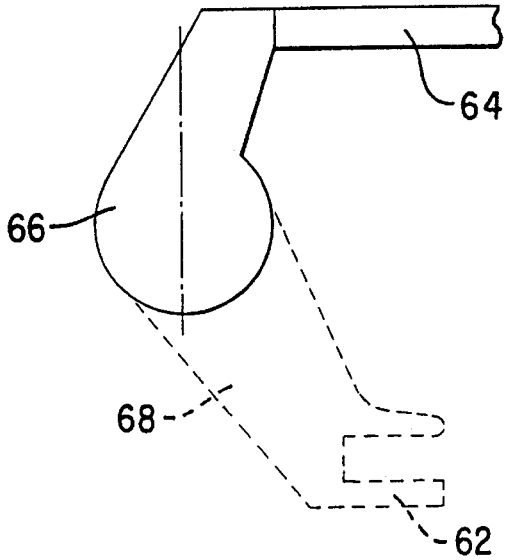

Remote regulation connector (2) is, before the weapon is launched, located between the two arms of fork (62). Once the weapon is launched, connector (20), integral with the torpedo, undergoes a translational movement relative to fork (62), which is integral with the container. By means of this translation, and because fork (62) has the profile of an inclined plane, as shown in FIG. 4*a*, the connector is raised. The greater the translation, the more connector (20) is raised and, once it has traveled a distance of 30 mm, the connector is ripped away from the weapon, as the weapon has been raised sufficiently from the connector. At this time, rod (64), which also undergoes a translational movement, exerts a force on lever arm (66). The lever arm undergoes a rotation relative to the axis drawn in FIG. 4*a*. Fork (62), connected by lower lever arm (68) to upper lever arm (66) undergoes the rotational movement as well. Since connector (60) is held by fork (62), it too undergoes the rotational movement.

For the torpedo, once launched from the ship, to be able to enter the water at a sufficient angle, without any ricocheting, a parachute may be added. In that case, the parachute opening is connected to a cable wound around a drum fixed to the container. The cable is longer than the container in order to allow the parachute to be implemented after going past a safety area adapted to the ship. The drum is housed in a slide located at the rear of the container. At the moment of launching, the cable reels off and after the distance travelled by the torpedo corresponds to the cable length, the traction exercised by the cable pulls out the parachute allowing it to open.

To sum up, the present invention, because of the use of a container for launching and storing the torpedo, it is possible to obtain a number of advantages such as:

a) the torpedo is protected during all the time it is handled.

b) the container can be used outside as well as inside.

c) the launching module can be lightweight and movable, and d) the external design of the container takes into account the handling and fixation of the action sections.

I claim:

1. A container intended for containing a lightweight weapon to be launched from a surface craft, said weapon including an activation means for batteries supplying energy to the weapon, means for extraction of an activation safety device when launching said weapon, and a remote control connection to supply the programming of weapon commands before said weapon is launched, said container comprising:

means for holding said weapon in a storage position; and means for separating said weapon from said container, wherein said activation means for the batteries, said means for extraction of the activation safety device, and disconnection of said remote control connection are interdependent with said container and are activated automatically at the moment said weapon is launched by separating said weapon from said container.

2. A container according to claim 1, wherein said activation means for the batteries and said extraction means for the activation safety device each comprises a pin preventing the activation of said activation means for the batteries and said extraction means when said container is in a storage position, and wherein the launching of the weapon and its separation from said container cause each said pin to be drawn out, resulting in the activation of at least one of said activation means for said batteries and said means for extraction of said activation safety device.

3. A container according to claim 2, wherein said pin is connected to a leaf spring fixed to said container, said leaf spring being under tension when said container is in the storage position, the drawing out of said pin causing the release of said leaf spring and the retraction of said pin into said container.

4. A container according to claim 1, wherein said remote control connection is shaped to fit in a fork fitted with an inclined plane allowing disconnection of said remote control connection when the weapon is launched from said container.

5. A container according to claim 4, wherein said fork is connected to a lever actuated by a thrusting element moved when the weapon is launched so as to discharge said fork and said connection laterally and therefore clear the passage of the weapon drift.

6. A container according to claim 1, wherein a launching module comprising a compressed air chamber is fixed on the rear of the container before the launching operation.

7. A container according to claim 6, wherein said weapon is shaped to fit on its rear part with a sphere blocked by two jaws to ensure the longitudinal immobilization of the weapon, both jaws being loosened and said sphere being released when said launching valve is opened.

8. A container for containing a lightweight weapon to be launched from a surface craft, the weapon including an activation device, safety device and a remote control connection, the activation device and the safety device each including a pin, said container comprising:

an internal space shaped to accommodate the weapon;

a locking device for holding the weapon in place during storage;

a launching module fixed to the rear of said container;

first and second leaf springs fixed to said container, said leaf springs connectable to the pins of said activation device and the safety device, wherein after launching, the pins are drawn into said container; and a disconnection assembly for disconnecting the remote control connection after launching.

9. A container according to claim 8, wherein said locking device comprises:

a rear supporting plate fixed to the rear of said container; and first and second clamps attached to said supporting plate and surrounding a terminal sphere of said weapon, said first and second clamps being held in place by first and second immobilizing locks, respectively.

10. A container according to claim 8, wherein said launching module includes a compressed air chamber.

11. A container according to claim 8, wherein said disconnection assembly for said remote control connection includes a fork fitted with an inclined plane.

12. A container according to claim 11, wherein said fork is connected to a lever actuated by a thrusting element upon launching.

13. A launching assembly comprising a container and a weapon, said weapon including an activation device, safety device and remote control connection, said activation device and said safety device each including a pin, said container comprising:

an internal space accommodating said weapon;

a launching device holding said torpedo in place during storage;

first and second leaf springs fixed to said container, said leaf springs connected to said pins of said activation device and said safety device, wherein after launching, said pins are drawn into said container; and a disconnection assembly disconnecting said remote control connection after launching.

14. A launching assembly according to claim 8, wherein said locking device comprises:

a rear supporting plate fixed to the rear of said container; and first and second clamps attached to said supporting plate and surrounding a terminal sphere of said weapon, said first and second clamps being held in place by first and second immobilizing locks, respectively.

15. A launching assembly according to claim 8, wherein said launching module includes a compressed air chamber.

16. A launching assembly according to claim 8, wherein said disconnection assembly for said remote control connection includes a fork fitted with an inclined plane.

17. A launching assembly according to claim 11, wherein said fork is connected to a lever actuated by a thrusting element upon launching.

* * * * *